US008360600B2

(12) United States Patent
Lin et al.

(10) Patent No.: US 8,360,600 B2
(45) Date of Patent: Jan. 29, 2013

(54) ELECTRONIC ILLUMINATING DEVICE

(75) Inventors: Chen-Chi Lin, Hsin-Chu (TW); Chieh-Wei Chen, Hsin-Chu (TW); Chun-Liang Lin, Hsin-Chu (TW); Ting-Kuo Chang, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 344 days.

(21) Appl. No.: 12/939,745

(22) Filed: Nov. 4, 2010

(65) Prior Publication Data

US 2011/0273872 A1 Nov. 10, 2011

(30) Foreign Application Priority Data

May 4, 2010 (TW) ..... 99114231 A

(51) Int. Cl.
*F21S 4/00* (2006.01)
*F21V 23/00* (2006.01)

(52) U.S. Cl. ..... 362/227; 362/249.06

(58) Field of Classification Search ..... 362/227, 362/249.06, 249.14
See application file for complete search history.

(56) References Cited

U.S. PATENT DOCUMENTS 6,683,669 B1 * 1/2004 Fujikawa ..... 349/149
6,879,367 B2 * 4/2005 Ukita ..... 349/149
7,063,449 B2 * 6/2006 Ward ..... 362/616
7,068,338 B2 6/2006 Taguchi et al.
7,414,605 B2 8/2008 Kobayashi et al.
7,580,034 B2 8/2009 Lee et al.
7,736,011 B2 * 6/2010 Kim et al. ..... 362/97.2
8,059,249 B2 * 11/2011 Liu et al. ..... 349/150
8,300,200 B2 * 10/2012 Jheng ..... 349/152
2006/0256272 A1 * 11/2006 Liou et al. ..... 349/149
2008/0117631 A1 * 5/2008 Kim et al. ..... 362/251
2009/0262066 A1 10/2009 Oke et al.

FOREIGN PATENT DOCUMENTS

CN 101498852 8/2009
CN 101520988 9/2009

* cited by examiner

*Primary Examiner* — Alan Cariaso
(74) *Attorney, Agent, or Firm* — WPAT PC; Justin King

(57) ABSTRACT

An electronic illuminating device includes an illuminating area, a routing area and a control area. The illuminating area includes multiple light-emitting blocks and multiple illuminating area power-supply lines. Each the light-emitting block employs at least one light-emitting element as light source, and further is electrically coupled to a corresponding one of the illuminating area power-supply lines. The routing area includes multiple routing area power-supply lines, and each the routing area power-supply line is electrically coupled to a corresponding one of the illuminating area power-supply lines. The control area provides powers to the routing area power-supply lines. A width of at least one of the illuminating area power-supply lines and the corresponding routing area power-supply line or a length of at least one of the routing area power-supply lines is adjusted, such that differences among resistances between the light-emitting blocks and the control area are within 20%.

10 Claims, 4 Drawing Sheets

ELECTRONIC ILLUMINATING DEVICE

BACKGROUND

1. Technical Field

The present invention relates to an electronic illuminating device and, particularly to an electronic illuminating device with uniform luminance.

2. Description of the Related Art

With the development of the science and technology, electronic illuminating devices are widely applied. For example, the electronic illuminating devices may be applied into liquid crystal display (LCD) devices as backlight modules of the LCD devices.

Refer to FIG. 1, which is a schematic view of a conventional electronic illuminating device. As shown in FIG. 1, the conventional electronic illuminating device 10 comprises a illuminating area 11 and a control area 12. The illuminating area 11 is composed of a plurality of light-emitting blocks 13. Each of the light-emitting blocks 13 uses at least one light-emitting element as light source. Each of the light-emitting blocks 13 is electrically coupled to the control area 12 through a corresponding power-supply line 14, such that the control area 12 outputs a driving signal to each of the light-emitting blocks 13 for emitting light.

However, the power-supply lines 14 between the light-emitting blocks 13 and the control area 12 have different lengths respectively, and thus the power-supply lines 14 have different resistances. As a result, powers consumed on the power-supply lines 14 are different when they transmit the driving signals, i.e., attenuation of the transmitted driving signals on the power-supply lines 14 are different, so that the driving signals received by the light-emitting blocks 13 are different respectively. The intensities of the light emitted from the light-emitting blocks 13 consequently are different; resulting in the luminance of the electronic illuminating device 10 is non-uniform.

BRIEF SUMMARY

Accordingly, the present invention relates to an electronic illuminating device with uniform luminance.

More specifically, an electronic illuminating device in accordance with an exemplary embodiment of the present invention comprises an illuminating area, a routing area and a control area. The illuminating area comprises a plurality of light-emitting blocks and a plurality of illuminating area power-supply lines. Each of the light-emitting blocks employs at least one light-emitting element as a light source, and the illuminating area power-supply lines are disposed in the illuminating area. Each of the light-emitting blocks is electrically coupled to a corresponding one of the illuminating area power-supply lines. The routing area comprises a plurality of routing area power-supply lines disposed therein, and each of the routing area power-supply lines is electrically coupled to a corresponding one of the illuminating area power-supply lines. The control area is electrically coupled to the routing area power-supply lines to provide powers to the routing area power-supply lines respectively. A width of at least one of the illuminating area power-supply lines and the corresponding routing area power-supply line or a length of at least one of the routing area power-supply lines is adjusted, such that differences among resistances between the light-emitting blocks and the control area within 20%.

In an exemplary embodiment of the present invention, the width of one of the illuminating area power-supply lines and the corresponding routing area power-supply line together given a longer total length, is larger than the width of another of the illuminating area power-supply lines and the corresponding routing area power-supply line together given a shorter total length. Preferably, the differences among the resistances between the light-emitting blocks and the control area are adjusted to be within 5%.

In an exemplary embodiment of the present invention, the length of the routing area power-supply line electrically coupled to the corresponding light-emitting block having a shorter linear distance from the control area, is larger than the length of the routing area power-supply line electrically coupled to the light-emitting block having a longer linear distance from the control area.

In an exemplary embodiment of the present invention, the at least one light-emitting element each is a light-emitting diode. Preferably, each of the illuminating area power-supply lines is electrically coupled to a terminal of the at least one light-emitting element.

In an exemplary embodiment of the present invention, the illuminating area power-supply lines are not alternately arranged with the light-emitting blocks along a first direction, and the illuminating area power-supply lines are alternately arranged with the light-emitting block along a second direction.

The electronic illuminating device of the present invention adjusts the widths of the illuminating area power-supply lines and the corresponding routing area power-supply lines, or adjust the lengths of the routing area power-supply lines, such that the differences among the resistances between the light-emitting blocks and the control area approximately are the same, e.g., within 20% and even within 5%. Therefore, driving signals outputted to the light-emitting blocks are approximately same and thus the electronic illuminating device can obtain the uniform luminance.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. Accordingly, the descriptions will be regarded as illustrative in nature and not as restrictive.

Figure 1:
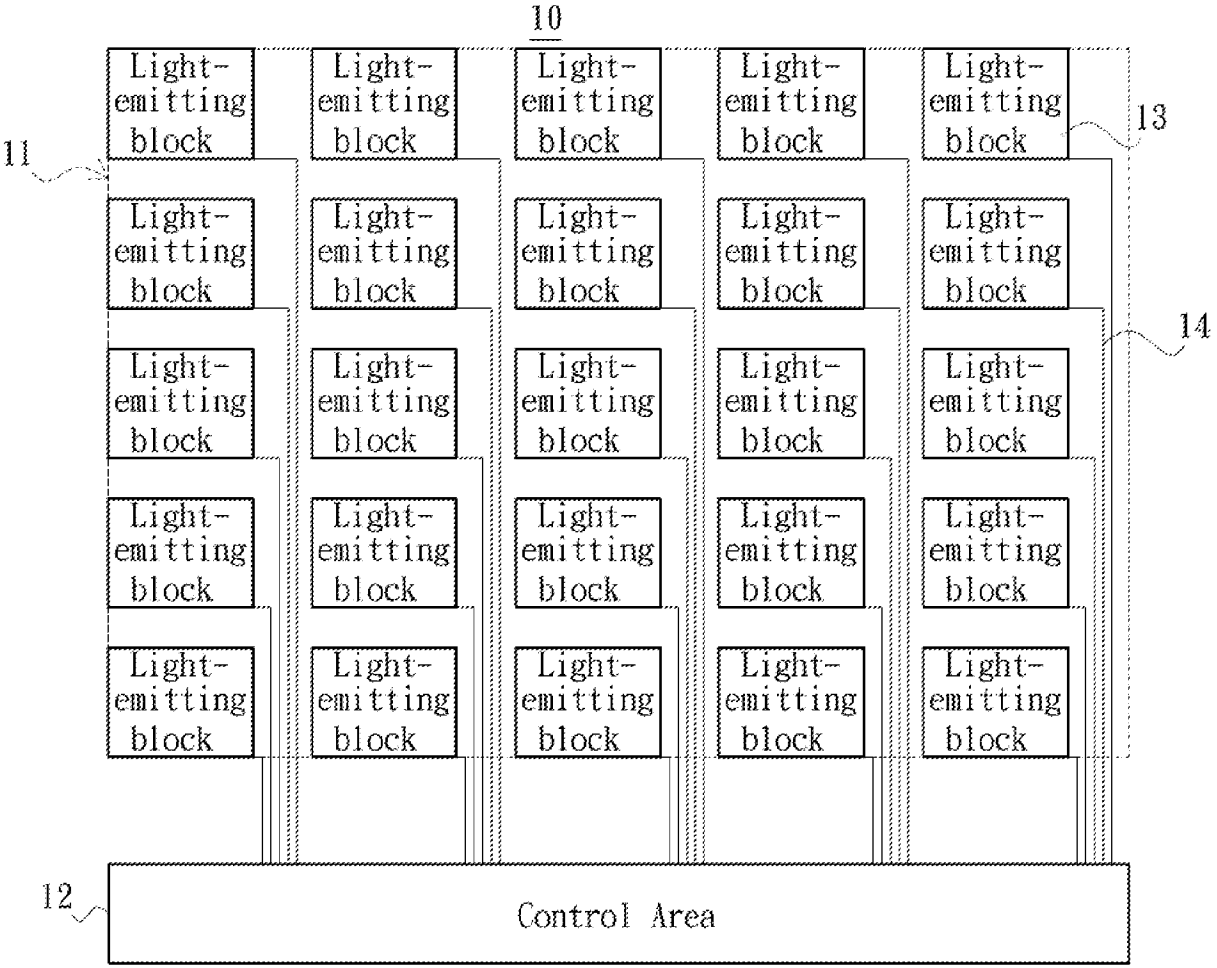
FIG. 1 (Related Art)
FIG. 1 is a schematic view of a conventional electronic illuminating device.
Figure 2:
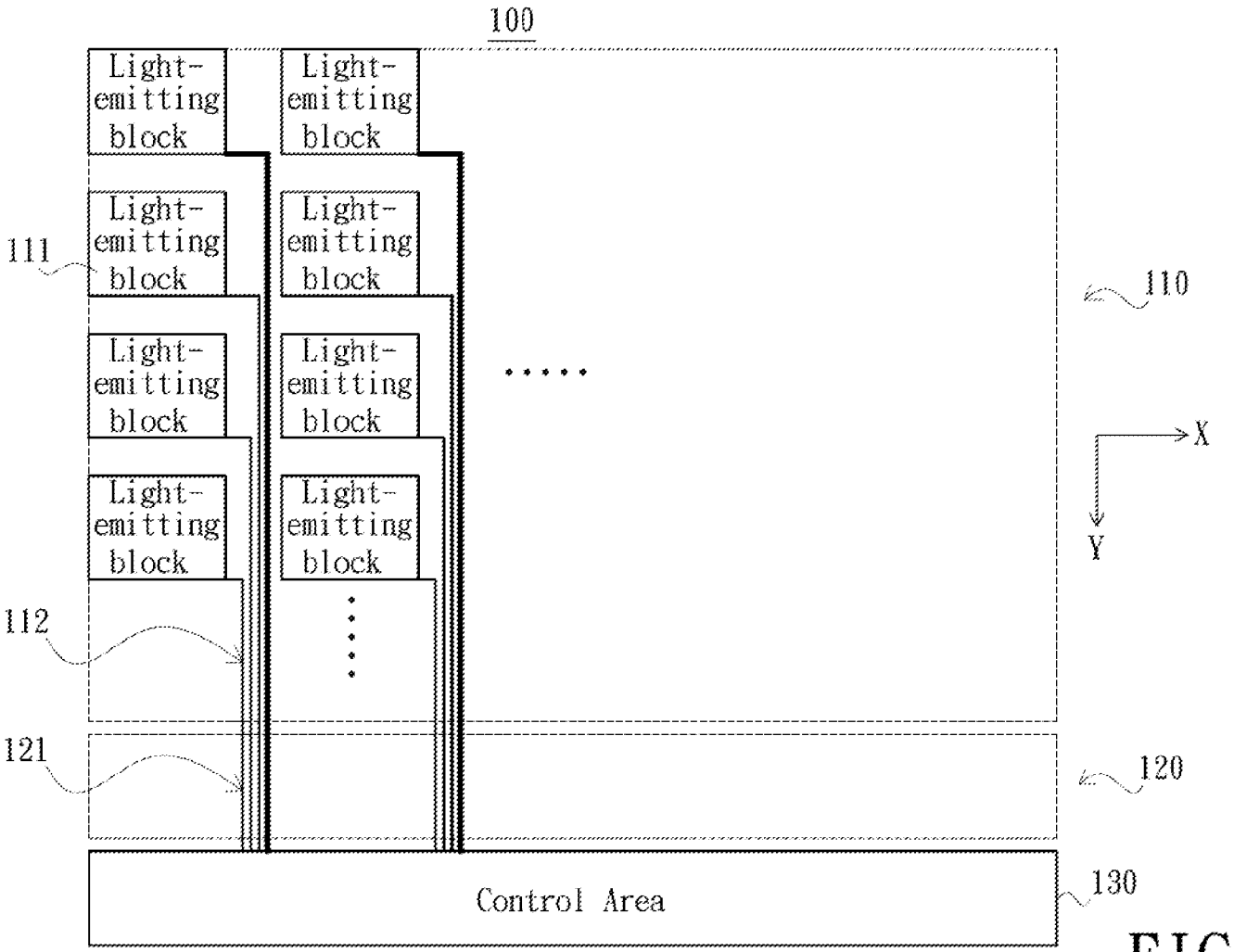
FIG. 2 is a schematic view of an electronic illuminating device in accordance with a first exemplary embodiment of the present invention.

Refer to FIG. 2, which is a schematic view of an electronic illuminating device in accordance with a first exemplary embodiment of the present invention. As shown in FIG. 2, the electronic illuminating device 100 comprises an illuminating area 110, a routing area 120 and a control area 130. The illuminating area 110 comprises a plurality of light-emitting blocks 111 and a plurality of illuminating area power-supply lines 112. Each of the light-emitting blocks 111 employs at least one light-emitting element as a light source. The light-emitting element may be a semiconductor light-emitting diode (LED) or an organic light-emitting diode (OLED). The illuminating area power-supply lines 112 are disposed in the illuminating area 110, and each of the light-emitting blocks 111 is electrically coupled to a corresponding one of the illuminating area power-supply lines 112.

The routing area 120 has a plurality of routing area power-supply lines 121 disposed therein, and each of the routing area power-supply lines 121 is electrically coupled between a corresponding one of the illuminating area power-supply lines 112 and the control area 130, such that a driving signal outputted from the control area 120 is transmitted to each of the light-emitting blocks 111 through the corresponding illuminating area power-supply line 112 and the corresponding routing area power-supply line 121.

In other words, each of the light-emitting blocks 111 is electrically coupled to the control area 130 through a corresponding power-supply line, where the corresponding power-supply line is divided into the corresponding illuminating area power-supply line 112 and the corresponding routing area power-supply line 121 which respectively pass through the illuminating area 110 and the routing area 120. In detail, the illuminating area power-supply lines 112 in the illuminating area 110 firstly extend along a direction X from each of the light-emitting blocks 111, and then extend along a direction Y to be electrically coupled to the corresponding routing area power-supply lines 121. That is, the illuminating area power-supply lines 112 and the light-emitting blocks 111 in the illuminating area 110 are alternately arranged along the direction X. Thus it can avoid the corresponding illuminating area power-supply line 112 corresponding to each of the light-emitting blocks 111 intersecting with other light-emitting blocks 111 or other illuminating area power-supply lines 112.

As shown in FIG. 2, linear distances of the light-emitting blocks 111 with respect to the control area 13 are different, e.g., partly different as illustrated or completely different in other embodiment instead, the lengths of the power-supply lines (i.e., the illuminating area power-supply lines 112 and the corresponding routing area power-supply lines 121) electrically coupled to the light-emitting blocks 111 respectively are different. In this exemplary embodiment of the present invention, the widths of the power-supply lines (comprising the illuminating area power-supply lines 112 and the corresponding routing area power-supply lines 121) electrically coupled to the respective light-emitting blocks 111 are also different. Furthermore, if the length of the power-supply line is longer, the width thereof is wider. That is, the electronic illuminating device of the exemplary embodiment adjust the widths of the power-supply lines to reduce the influence of resistance caused by the lengths of the power-supply lines, such that the resistances of the power-supply lines are approximately the same or completely the same. In this exemplary embodiment, the electronic illuminating device adjusts the widths of the power-supply lines to make the differences among the resistances of the power-supply lines be within 20%. Preferably, the differences among the resistances of the power-supply lines are regulated within 5%.

Figure 3:
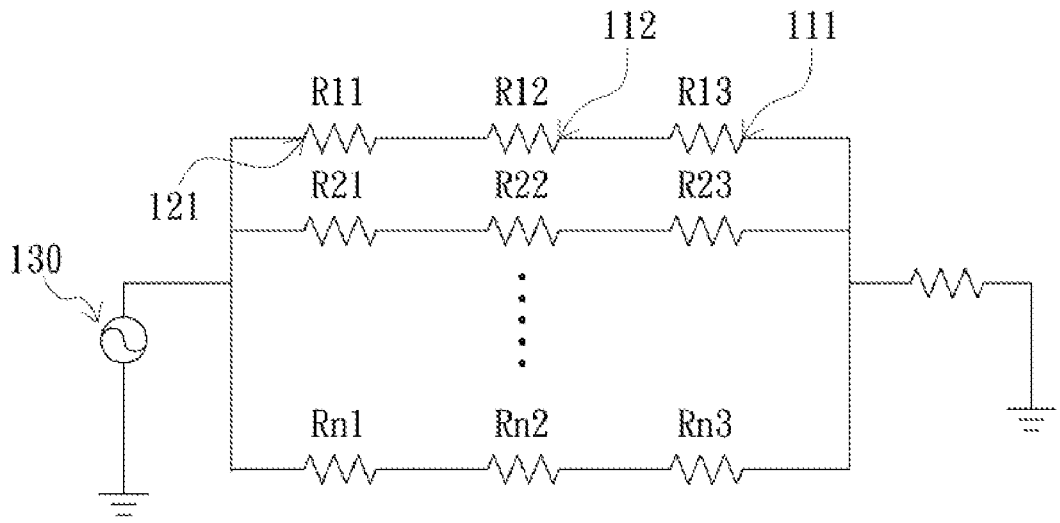
FIG. 3 is an equivalent circuit schematic view of the electronic illuminating device as shown in FIG. 2.

Refer to FIG. 3, which is an equivalent circuit schematic view of the electronic illuminating device as shown in FIG. 2. As shown in FIG. 3, the resistances of the light-emitting blocks 111 are R13, R23 . . . Rn3 respectively. The resistances of the illuminating area power-supply lines 112 electrically coupled to the light-emitting blocks 111 respectively are R12, R22 . . . Rn2. The resistances of the routing area power-supply lines 121 electrically coupled to the illuminating area power-supply lines 112 respectively are R11, R21 . . . Rn1. The electronic illuminating device 100 of the exemplary embodiment adjust the widths of the illuminating area power-supply lines 112 and the routing area power-supply lines 121, such that the differences among the resistance sums (R11+R12), (R21+R22) . . . (Rn1+Rn2) is kept within 20%. Therefore, after the driving signals outputted from the control area 130 pass through the corresponding illuminating area power-supply lines 112 and the corresponding power-supply lines 121 and then reach the light-emitting blocks 111, the differences among attenuations of the driving signals are also kept within 20%, such that the light-emitting blocks 111 can emit substantially same luminance.

Of course, it is understood for persons skilled in the art that, the present invention can also only adjust the widths of the illuminating area power-supply lines 111 in the illuminating area 110, or the widths of the routing area power-supply lines 121 in the routing area 120, or the widths of a part of the illuminating area power-supply lines 111, or the widths of a part of the routing area power-supply lines 121, so long as it can make the resistance sums (R11+R12), (R21+R22) . . . (Rn1+Rn2) of the illuminating area power-supply lines 112 and the corresponding routing area power-supply lines 121 associated with the respective light-emitting blocks 111 be substantially the same.

Figure 4:
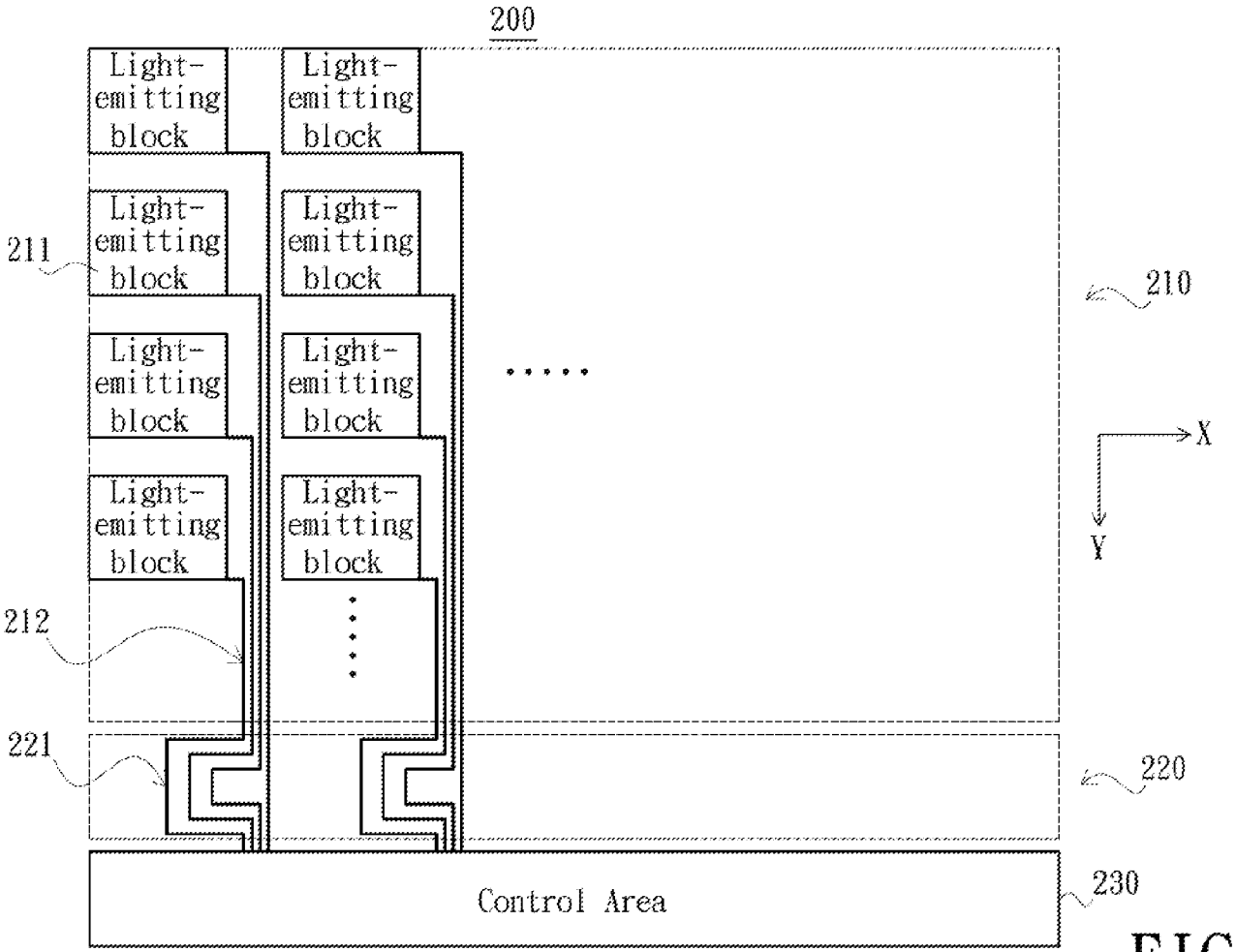
FIG. 4 is a schematic view of an electronic illuminating device in accordance with a second exemplary embodiment of the present invention.

Refer to FIG. 4, which is a schematic view of an electronic illuminating device in accordance with a second exemplary embodiment of the present invention. As shown in FIG. 4, the electronic illuminating device 200 is similar with the electronic illuminating device 100 as shown in FIG. 2, except that the widths of the illuminating area power-supply lines 212 in the illuminating area 210 and the corresponding routing area power-supply lines 221 in the routing area 220 are the same, and the lengths of the routing area power-supply lines 221 in the routing area 220 are different. In detail, if the light-emitting block 211 is farer from the control area 230, the corresponding routing area power-supply line 221 has a shorter length in the routing area 220. On the contrary, if the light-emitting block 211 is nearer to the control area 230, the corresponding routing area power-supply line 221 has a longer length in the routing area 220.

That is, the length sums of the respective illuminating area power-supply lines 212 and the corresponding routing area power-supply lines 221 between the light-emitting blocks 211 and the control area 230, i.e., the length sums of the respective power-supply lines passing through both the illuminating area and the routing area are approximately the same or completely the same. Thus the resistance sums of the respectively illuminating area power-supply lines 212 and the corresponding routing area power-supply lines 221 are substantially the same. Preferably, the differences among the resistance sums may be kept within 20%.

In summary, the electronic illuminating device of the present invention adjust the widths of the illuminating area power-supply lines and the corresponding routing area power-supply lines, or adjust the lengths of the routing area power-supply lines, such that the resistances of the power-supply lines between the light-emitting blocks and the control area substantially same. Therefore, the driving signals outputted to the light-emitting blocks are substantially same and thus the electronic illuminating device can obtain the uniform luminance.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An electronic illuminating device, comprising:

an illuminating area comprising:

a plurality of light-emitting blocks, each of the light-emitting blocks using at least one light-emitting element as a light source; and a plurality of illuminating area power-supply lines disposed in the illuminating area, and each of the illuminating area power-supply lines being electrically coupled to a corresponding one of the light-emitting blocks;

a routing area comprising a plurality of routing area power-supply lines, each of the routing area power-supply lines being electrically coupled to a corresponding one of the illuminating area power-supply lines; and a control area electrically coupled to the routing area power-supply lines to supply powers to the routing area power-supply lines, wherein a width of at least one of the illuminating area power-supply lines and the corresponding routing area power-supply line or a length of at least one of the routing area power-supply lines is adjusted, and thereby differences among resistances between the light-emitting blocks and the control area are within 20%.

2. The electronic illuminating device as claimed in claim 1, wherein the width of one of the illuminating area power-supply lines and the corresponding routing area power-supply line together given a longer total length is larger than the width of another of the illuminating area power-supply lines and the corresponding routing area power-supply line together given a shorter total length.

3. The electronic illuminating device as claimed in claim 2, wherein the differences among the resistances between the light-emitting blocks and the control area are adjusted to be within 5%.

4. The electronic illuminating device as claimed in claim 1, wherein the length of the routing area power-supply line electrically coupled to the corresponding light-emitting block having a shorter linear distance from the control area, is larger than the length of the routing area power-supply line electrically coupled to the corresponding light-emitting block having a longer linear distance from the control area.

5. The electronic illuminating device as claimed in claim 1, wherein the at least one light-emitting element each is a light-emitting diode.

6. The electronic illuminating device as claimed in claim 5, wherein each of the illuminating area power-supply lines is electrically coupled to a terminal of the at least one light-emitting element.

7. The electronic illuminating device as claimed in claim 1, wherein the illuminating area power-supply lines are not alternately arranged with the light-emitting blocks along a first direction, and the illuminating area power-supply lines are alternately arranged with the light-emitting blocks along a second direction.

8. An electronic illuminating device, comprising:

a plurality of light-emitting blocks, each of the light-emitting blocks using at least one light-emitting element as a light source;

a plurality of power-supply lines respectively electrically coupled to the light-emitting blocks; and a control area electrically coupled to the light-emitting blocks through the respective power-supply lines;

wherein linear distances of the light-emitting blocks with respect to the control area are different, wherein widths of the power-supply lines as well as lengths of the power-supply lines are different such that differences among resistances between the light-emitting blocks and the control area are within 20%.

9. The electronic illuminating device as claimed in claim 8, wherein the differences among the resistances between the light-emitting blocks and the control area are within 5%.

10. An electronic illuminating device, comprising:

a plurality of light-emitting blocks, each of the light-emitting blocks using at least one light-emitting element as a light source;

a plurality of power-supply lines respectively electrically coupled to the light-emitting blocks; and a control area electrically coupled to the light-emitting blocks through the respective power-supply lines;

wherein linear distances of the light-emitting blocks with respect to the control area are different, wherein widths of the power-supply lines are substantially the same, and lengths of the power-supply lines also are substantially the same.

* * * * *